US005738230A

United States Patent [19]

Goldstein

[11] Patent Number: 5,738,230

[45] Date of Patent: Apr. 14, 1998

[54] FOLDING FURNITURE WITH HIDDEN INTERNAL HINGE

[76] Inventor: Jaime Abraham Berdichevsky Goldstein, Paul Harris 10170, Las Condes-Santiago, Chile

[21] Appl. No.: 613,855

[22] Filed: Mar. 11, 1996

[30] Foreign Application Priority Data

Mar. 15, 1995 [CL] Chile ..... UM 387 95 U

[51] Int. Cl.[6] ..... A47F 5/00

[52] U.S. Cl. ..... 211/149; 211/186

[58] Field of Search ..... 211/149, 186, 211/195, 189; 108/99, 115

[56] References Cited

U.S. PATENT DOCUMENTS

| | | | |
|---|---|---|---|
| 722,780 | 3/1903 | Scarborough . | |
| 915,618 | 3/1909 | Mattison | 211/149 X |
| 1,032,054 | 7/1912 | Fanning . | |
| 1,079,057 | 11/1913 | Meyer . | |
| 1,602,410 | 10/1926 | Hamblin | 211/149 X |
| 1,751,677 | 3/1930 | Amstutz . | |
| 4,949,851 | 8/1990 | Shaffer | 211/149 |
| 5,257,701 | 11/1993 | Edelson | 211/149 |
| 5,315,936 | 5/1994 | Smith | 211/149 X |
| 5,465,851 | 11/1995 | Smith | 211/149 X |

OTHER PUBLICATIONS 4 prior art tear sheets showing folding furniture with hinges.

*Primary Examiner*—Alvin C. Chin-Shue
*Assistant Examiner*—Sarah Purol
*Attorney, Agent, or Firm*—Amster, Rothstein & Ebenstein

[57] ABSTRACT

A folding article of furniture, such as a bookcase or other storage unit, has in its conventional aspects a vertically extending back piece, at least one vertically extending side piece secured to the back piece, and a vertically spaced plurality of shelves secured to the back piece. Each side piece is pivotable over a 90° angle relative to the back piece between a parallel or collapsed orientation and a perpendicular or use orientation, and each shelf is pivotable over a 90° angle relative to the back piece between a parallel or collapsed vertical orientation and a perpendicular or use horizontal orientation. In its novel aspects, the side piece and the back piece are secured together without a hinge.

15 Claims, 3 Drawing Sheets

FOLDING FURNITURE WITH HIDDEN INTERNAL HINGE

BACKGROUND OF THE INVENTION

The present invention relates to folding furniture and, in particular, to folding furniture which does not utilize visible external hinges.

The size of furniture is an appreciable factor in the cost of furniture delivered to a consumer because of its effect on the costs involved in packaging, shipping and storing of the furniture. In an effort to reduce such costs, resort has been had to furniture requiring at least some assembly by the consumer. Consumers frequently have a distaste for even "easy to assemble" labelled furniture because of the challenge to their mechanical skills and ability to follow instructions, the time involved in assembly, and the possibility of losing unassembled pieces. Finally, the sad fact is that the "assembled" product, when designed to be assembled by a layman, is often less appealing than was pictured, e.g., on the front of the package or than preassembled furniture.

Many of the same economies of packaging, shipping and storage can in suitable instances be achieved by "folding" furniture—that is, furniture in which the various components are already assembled (i.e., secured together), and merely have to be unfolded or pivoted relative to the other components in order to achieve the desired "unfolded" or "erected" orientation for the final product (without the use of tools). Such folding furniture typically relies to a large degree on visible external hinges. However, hinges are frequently unsightly and, when exposed, suggest inexpensive "homemade", "assembled" or "folding" furniture rather than more costly preassembled furniture which is sold in an erect state.

Additionally, the presence of external hinges can impair the functionality of the "folding" furniture. For example, in a folding bookcase the side pieces of the bookcase may be secured to the back piece of the bookcase by hinges so that the side pieces can be folded parallel to the back piece (with the pivotable shelves in a raised vertical orientation) for compact shipment and storage, yet pivoted outwardly until perpendicular to the back piece (with the shelves dropped to a horizontal orientation) for normal "erected" use. In order to conceal the external hinges, they are typically situated such that the presence of books in the erected bookcase conceals them from view. However in such positions, they typically bear against and/or otherwise interfere with placement of the first and last books (that is, the leftmost and rightmost books) on a shelf. Except in the most expensive folding bookcases, where recesses are provided in the back piece and side pieces for receipt of the arms of the hinge (and any screws connecting the hinge arms to the front or back pieces), the hinge arms typically extend into the space designed for occupancy by books and thus reduce the book-storing capacity of the bookcase. Squeezing in a book, either at the rightmost or leftmost end of the shelf, may result in damage to the cover and/or even the pages of the squeezed-in book.

Accordingly, an object of the present invention to provide "folding furniture" which does not utilize visible external hinges.

Another object is to provide such folding furniture in the form of a storage unit (e.g., a bookcase) wherein in a preferred embodiment the side pieces are pivotable over 90 degrees relative to the back piece without reducing the storage space (e.g., shelf space available for books.)

A further object is to provide such folding furniture which in a preferred embodiment appears like preassembled furniture purchased in the erect state.

It is another object of the present invention to provide such folding furniture which in a preferred embodiment is simple and inexpensive to manufacture and erect.

It is a further object of the present invention to provide such folding furniture which in a preferred embodiment can be readily modified, yet utilizes the same primary components.

It is a still further object of the present invention to provide such folding furniture which in a preferred embodiment is durable for shipping in the folded state.

SUMMARY OF THE INVENTION

It has now been found that the above and related objects of the present invention are obtained in a folding article of furniture such as a bookcase or other storage unit having at least one hidden internal hinge (instead of a visible external hinge).

In its conventional aspects the folding article comprises a vertically extending back piece, at least one vertically extending side piece secured to the back piece, and a vertically spaced plurality of shelves secured to the back piece. Each side piece is pivotable over a 90° angle relative to the back piece between a parallel or collapsed orientation and a perpendicular or use orientation, and each shelf is pivotable over a 90° angle relative to the back piece between a parallel or collapsed vertical orientation and a perpendicular or use horizontal orientation. In its novel aspects, the side piece and the back piece are secured together by at least on hidden internal hinge.

In a preferred embodiment, one of the side piece and the back piece defines a vertically spaced plurality of lugs, each lug defining an aperture therethrough. The other of the side piece and the back piece defines a vertically spaced plurality of slits, each of the slits being disposed, configured and dimensioned to receive a respective one of the lugs with the lug aperture in the slit. The article additionally defines at least one pivot member, each pivot member having a body extending vertically through the aperture of a respective one of the lugs and a pair of opposed ends journalled into the other of the side piece and the back piece above and below the respective one lug aperture. Preferably the article defines a vertically spaced plurality of the pivot members, each pivot member extending vertically through a respective one of the lug apertures and being journalled into the other of the side piece and the back piece above and below the respective one lug aperture.

More particularly, in the preferred embodiment the back piece comprises a horizontally spaced pair of vertically extending T-shaped side bars and means connecting the side bars. Each side bar defines in cross section a transverse member and an inwardly extending flange forming a pair of internal corners. One of the internal corners is occupied in part by the connecting means, and the other of the internal corners is occupied in part by an edge of the side piece without blocking pivotal movement of the side piece edge over a 90° angle.

Preferably a front of an uppermost of the shelves is pivotable upwardly such that, when the article is in a collapsed orientation with the uppermost shelf intermediate the back piece and the side piece, the uppermost shelf, the back piece and the side piece define tops at a common level.

Preferably the back piece has a horizontally spaced pair of lateral ends, and the article has a pair of side pieces, each side piece being secured to a respective lateral end of the back piece.

The article is preferably in the form of a bookcase or other storage unit.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
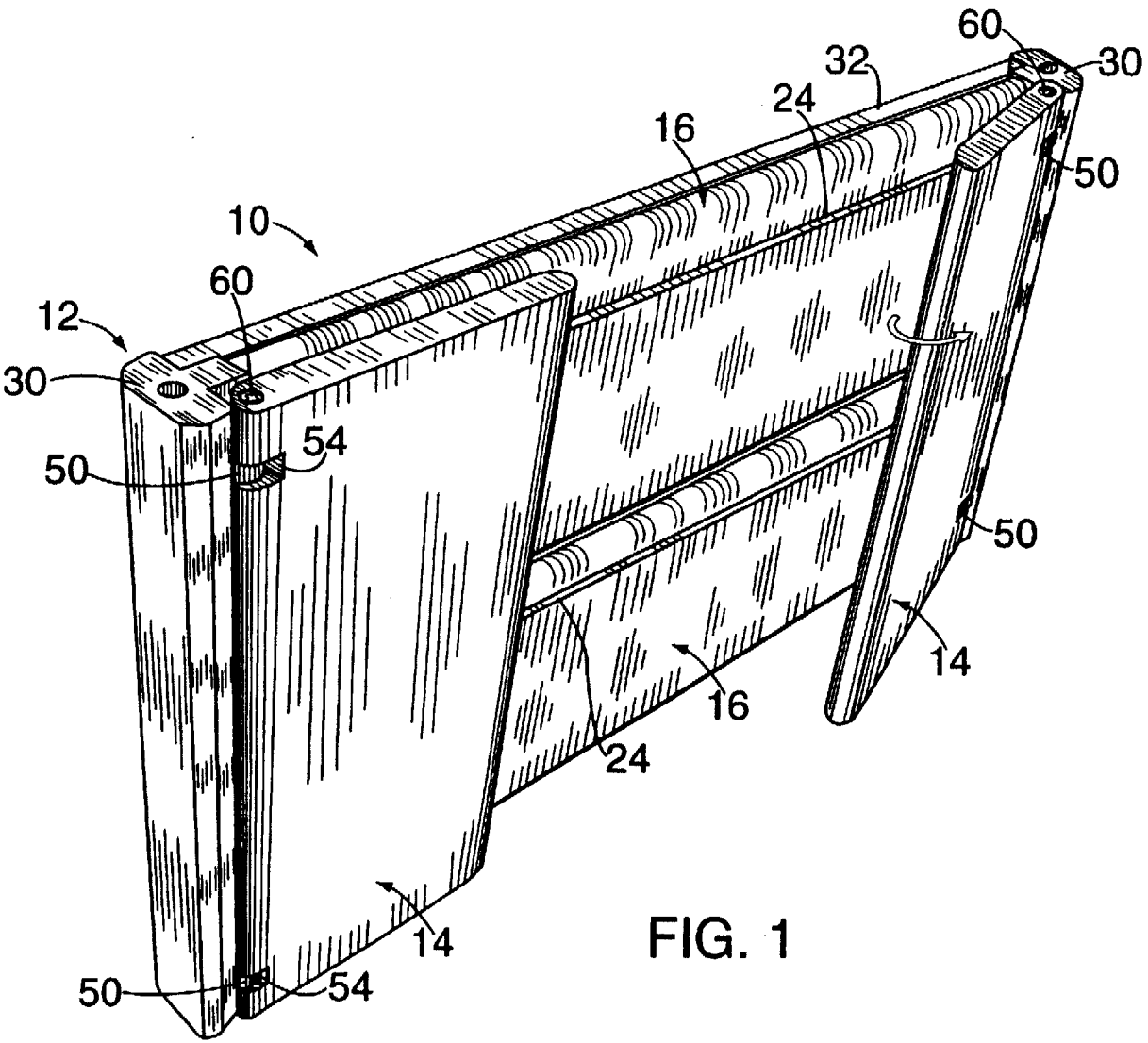
FIG. 1 is a perspective view of a bookcase according to the present invention in a partially folded orientation.
Figure 2:
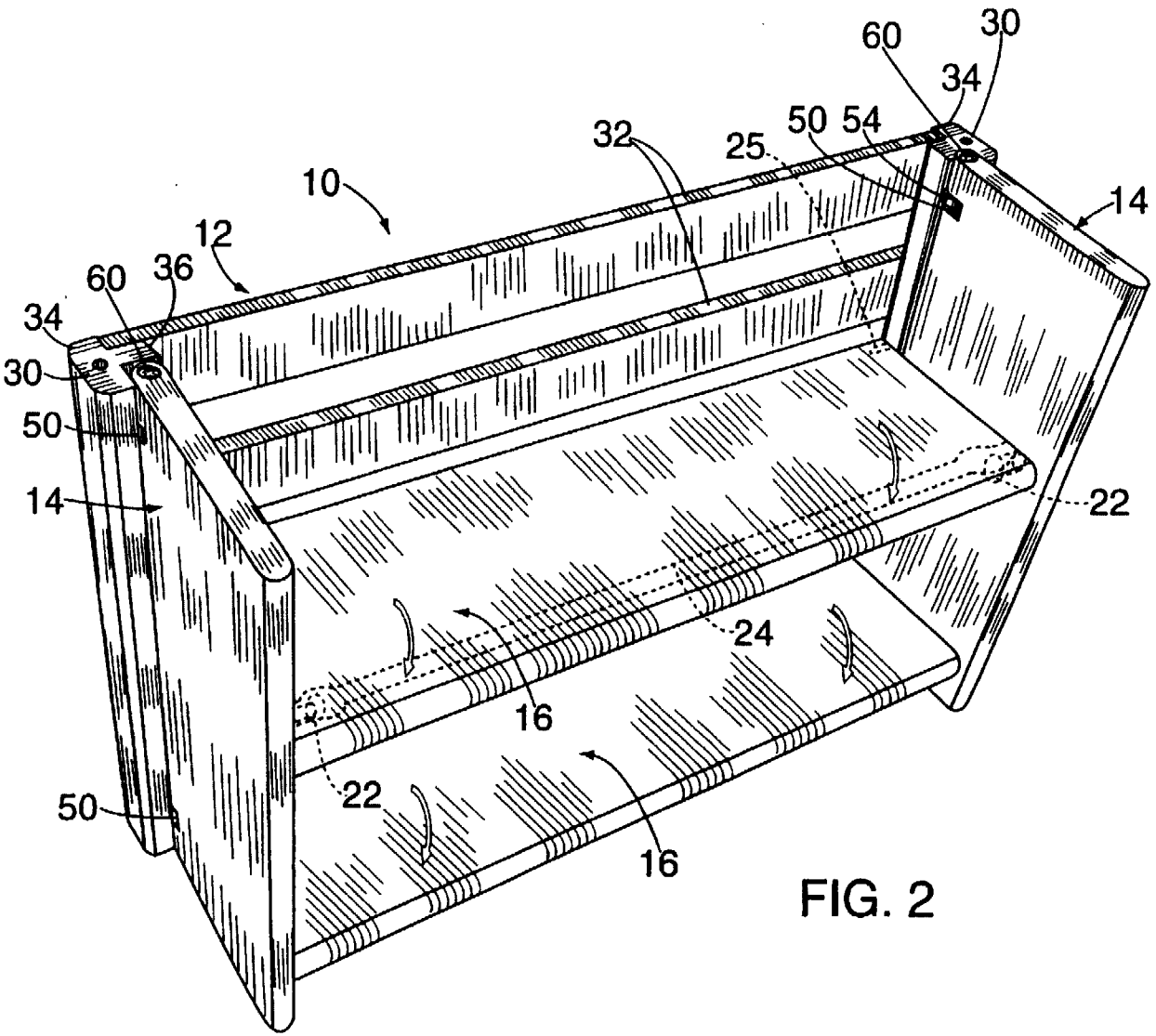
FIG. 2 is a perspective view of the bookcase in a fully erected orientation.

Referring now to the drawing, and in particular to FIGS. 1 and 2 thereof, therein illustrated is an article of folding furniture according to the present invention, generally designated by the reference numeral 10. The article 10, as illustrated, is a bookcase having as its principal components: a back piece generally designated 12, at least one vertically extending side piece generally designated 14, and a vertically spaced plurality of shelves generally designated 16. As illustrated, there are a pair of side pieces 14, each side piece 14 being secured to a respective lateral end 20 of the back piece 12 such that the side piece 14 is pivotable over a 90° angle (and typically over a 180° angle) relative to the back piece 12 between the parallel or collapsed orientation illustrated in FIG. 1 for the left side piece 14 and the perpendicular or use orientation illustrated in FIG. 2 for both side pieces 14. As illustrated, there are two shelves 16, each shelf 16 being secured to the back piece 12 intermediate the lateral ends thereof such that it is pivotable over at least a 90° angle (and typically over a 180° angle) relative to the back piece between the parallel or collapsed vertical orientation illustrated in FIG. 1 and the perpendicular or use horizontal orientation illustrated in FIG. 2. In the normal use orientation of the bookcase 10, the back piece 12 and side pieces 14 extend vertically while the shelves 16 extend substantially horizontally. Shelves 16 are preferably vertically spaced when in either the horizontal orientation or the vertical orientation.

The three principal components 12, 14 and 16 are formed of a substantially rigid, inflexible material such as wood, whether natural or synthetic and whether veneered or not.

As is customary in folding bookcases, when the bookcase is in the erected use orientation, the side pieces 14 define inward projections 22 and the bottom surfaces of the shelves 16 define recesses 24 adjacent the front thereof configured and dimensioned to receive the sidewall projections 22 at least partially therein, so that the shelves 16 are supported in the horizontal use orientation by the side piece projections 22 at the front thereof and the pins 25 (see FIG. 3) pivotally joining each end of the back of each shelf 16 to the back piece 12.

The bottom surfaces of the shelves 16 also define recesses 26 adjacent the rear thereof configured and dimensioned to receive the side wall projection 22 at least partially therein, so that the rear recesses 26 receive the forward projections 22 when the shelves 16 are in the vertical storage orientation and the side pieces 14 have been pivoted until they are parallel with the back piece 12. The ability of the forward projections 22 of the side pieces 14 to engage the front recesses 24 to support the pivotable shelves 16 when the bookcase 10 is in the erected or use orientation and to be received within the rear recesses 26 when the bookcase 10 is in the collapsed or storage orientation is conventional and hence need not be described herein in any further detail. The use of pins 25 to pivotally mount the shelves 16 on the back piece 12 is also conventional.

It is a novel and critical feature of the present invention that the side piece 14 (or side pieces 14 as the case may be) and the back piece 12 are secured together by one or more hidden internal hinges. Accordingly, the bookcase 10 appears to be an ordinary article of furniture, purchased in an erected state, since there is no unsightly visible external hinge. Further, as there is no hinge present, the end books on each shelf 16 may be removed or inserted without any damage to the cover or pages thereof, as might occur if the book were being squeezed into an end portion of a shelf adjacent to an external hinge.

Figure 4:
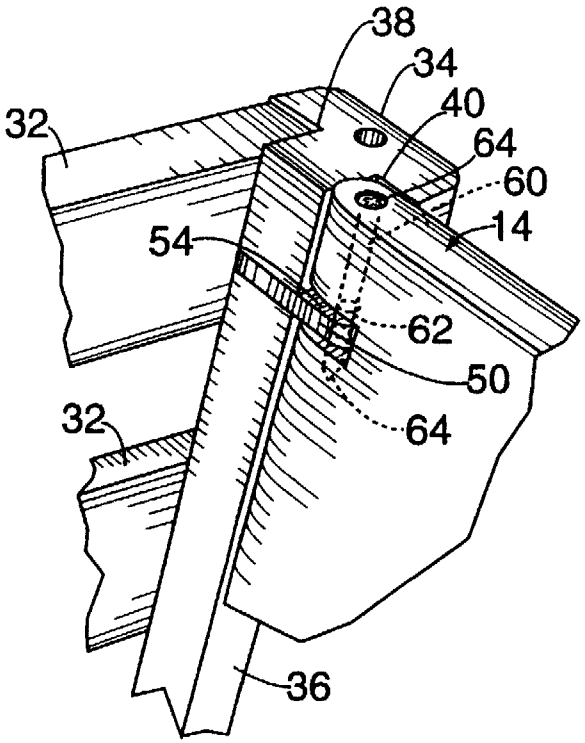
FIG. 4 is a fragmentary assembly perspective view thereof.
Figure 3:
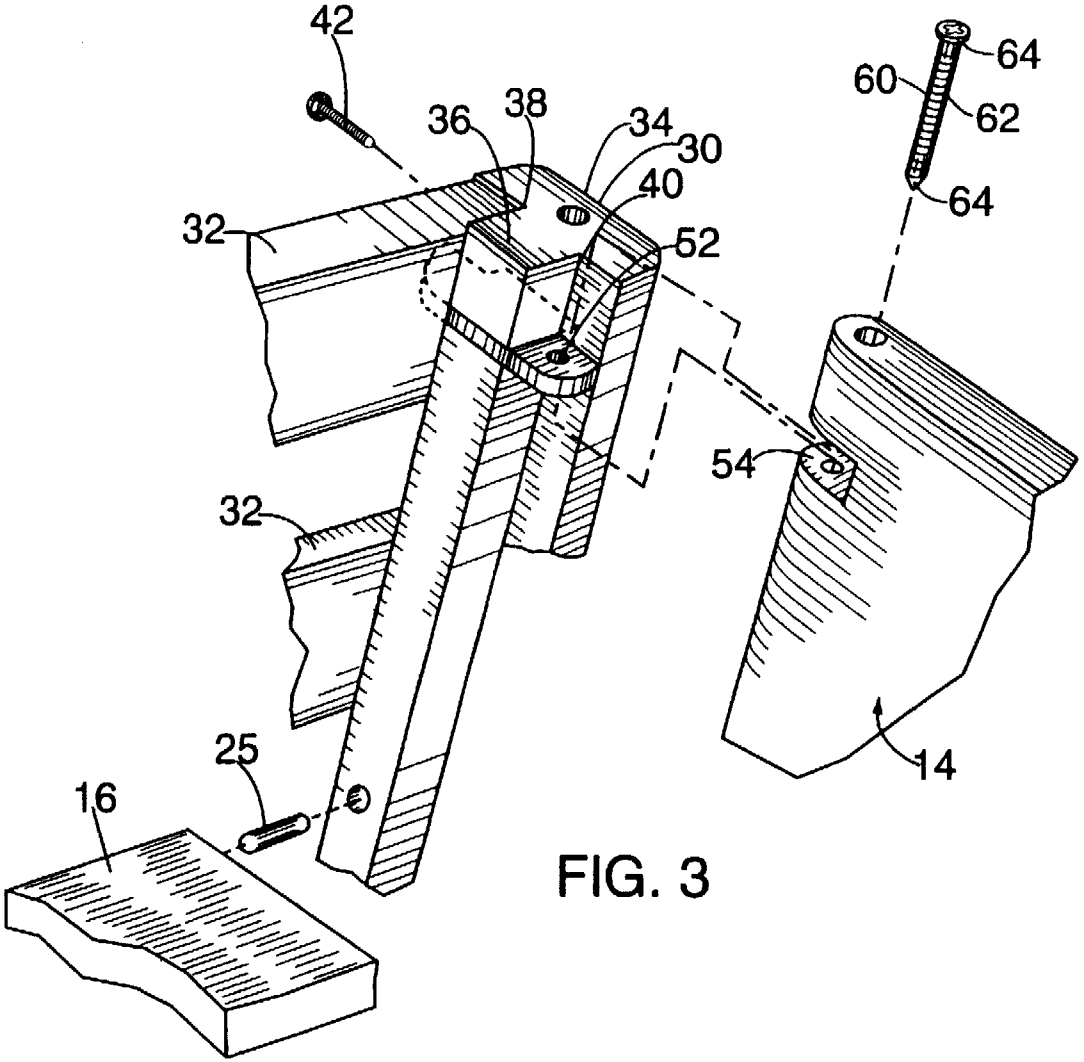
FIG. 3 is a fragmentary, partially exploded perspective view of the connection between the T-bar of the back piece and a side piece, a shelf and a connecting means.

Referring now to FIGS. 3 and 4 as well, as illustrated the back piece 12 comprises a horizontally spaced pair of vertically extending T-shaped side bars 30 (hereinafter "T-bars") and means 32 connecting the T-bars 30. Each T-bar 30 defines in cross section a transverse member 34 (extending between the front and rear of the collapsed bookcase 10) and an inwardly extending flange 36. The flanges 36 of the two T-bars 30 face one another and are separated by the shelves 16 pivotally secured thereto. In cooperation, each transverse member 34 and its inwardly extending flange 36 define a pair of internal corners 38, 40. The back internal corner 38 is occupied in part by one end of the connecting means 32, and the front internal corner 40 is occupied in part by an edge of a side piece 14.

Preferably there are a plurality of vertically spaced connecting means 32 in the form of separate rectangles or flat bars. Each end of each connecting means 32 is secured—for example, by a screw 42 (see FIG. 3)—to a back internal corner 38, the end being rectangular in cross section and sitting within an internal right angle corner 38 to form a rigid joint therewith. The number of vertically spaced apart connecting means 32 used to connect the two T-bars 30 will depend, of course, upon the height of the bookcase 10. Typically, there are at least two connecting means, one adjacent the top of the bookcase and one adjacent the bottom, however a single connecting means can constitute the entire back of the bookcase. The connecting means can be of any width.

By way of contrast to the fixed, rigid joint between the connecting means 32 and the T-bar 30 in the back internal corner 38, the end of the side piece 14 sitting within the front internal corner 40 must be able to pivot over a 90° angle. To this goal, the end of the side piece 14 sitting within the front internal corner 40 (and for aesthetic reasons the opposite end as well) is preferably rounded. In order to form the pivotable joint at the front internal corner 40, the T-bar 30 defines a vertically spaced pair of lugs 50, each lug 50 defining an aperture 52 extending vertically therethrough. The end of the side piece 14 which is to fit within that front internal corner 40 defines a vertically spaced pair of slits 54, each slit 54 being disposed, configured and dimensioned to receive a respective one of the lugs 50, with the lug aperture 52 within the slit 54. Preferably, one of the vertically spaced pair of slits 54 is positioned adjacent the top of the bookcase 10 and the other slit 54 adjacent to the bottom of the bookcase 10, with the lugs 50 being vertically spaced such that the top lug 50 fits into the top slit 54 and the bottom lug 50 fits into the bottom slit 54.

While in the embodiment illustrated there are only a vertically spaced pair of lugs 50 and a vertically spaced pair of slits 54, it will be appreciated that, again depending upon the height of the bookcase 10 and the desired strength of the back piece/side piece joint 12/14, there may be three or more vertically spaced lugs and a corresponding number of vertically slits in each front internal corner 40. The number of slits and lugs is not necessarily related to the number of shelves 16 or connecting means 32.

Each article 10 additionally defines at least one pivot member 60 having a body 62 and a pair of opposed ends 64 connected by the body 62. Each pivot member body 62 extends vertically through the aperture 52 of a respective one of the lugs 50. While the body 62 may be cylindrical, it is optionally lightly threaded (and one end 64 provided with a screw head) for reasons having to do with a preferred manufacturing process for the article 10. The opposed ends 64 of each pivot member 60 are journalled into the back piece 12 above and below the respective lug aperture 52 occupied by the body 62. As the pivot member 60 joins a back piece lug 50 and a side piece slit 54, there is typically one pivot member 60 for each lug/slit assembly 50/54. Naturally each slit 54 is of sufficient depth to enable pivotable movement of the lug 50 relative to the slit 54, and the lug 50 is dimensioned so that the adjacent edge of the side piece 14 is sufficiently spaced from the walls of the front internal corner 40 to enable limited pivotal movement of the side piece 14 relative to the back piece 12 over at least 90° and preferably over 180°. The pivot members 60 and pins 25 are preferably formed of metal for strength and durability.

Each T-bar 30 is an assembly of a unitarily formed transverse member 34 and flange 36, on the one hand, and a plurality of separately formed lugs 50, on the other hand. A groove or recess is formed through the flange 36 and partially into the adjacent face of the transverse member 34 so that the lug 50 may be suitably fitted therein and glued thereto, with one end of the lug occupying the back internal corner 38 and the other end of the lug occupying the front internal corner 40. As the forces acting on the lug 50 in the erected article 10 are primarily vertical in direction, this typically suffices to maintain the lug 50 in place on the T-bar 30. The lug aperture 52 is, of course, pre-formed in the end of the lug 50 to be situated in the front internal corner 40 and, optionally, also in the end thereof adapted to be situated in the back internal corner 38. While the T-bar 30 has been described as an assembly of a transverse member and a plurality of lugs, it is anticipated that it may be possible to form the T-bar and lugs integrally.

The pivot member 60 is preferably in the form of a screw which has been driven from the top or bottom of the side piece 14, through an adjacent slit 54 and into a portion of the side piece 14 on the other side of the slit 54. Thus the body 62 of the pivot member 60 is disposed within a slit 54, while the ends 64 of the pivot member 60 are journalled within the side piece 14 to either side of the slit 54. For the purposes of the present invention, the "journalling" of the pivot member end 64 in a side piece may or may not leave the pivot member 60 rotatable relative to the side piece 14. Thus an appropriate cavity for pivot member 60 could be created by machining the side piece edge, from the top or bottom of the side piece, through the slit 54 adjacent thereto, and into a portion of the side piece 14 on the other side of the slit 54. Once the cavity has been machined, a cylindrical pivot member may be inserted into the cavity such that it extends to both sides of the slit 54. The portion of the cavity extending to the top or bottom of the side piece 14 may then be filled in to maintain the pivot member 60 within the cavity. The pivot member may be fixed or rotatable within the cavity.

Where the side pieces 14 are particularly heavy or a particularly strong side piece/back piece joint is required, each end of the connecting means 32 may define a pair of slits 54 and the T-bar 30 may define a pair of lugs 50 adapted to be engaged by such slits.

It will be appreciated by those skilled in the art that the lugs 50 may be formed in the T-bar 30 and that the slits 54 may be formed in the side piece 14 by means which will suggest themselves to those skilled in the art as well as those described herein.

It will further be appreciated by those skilled in the art that the lugs 50 may be formed in the side piece 14 and the slits 54 may be formed in the T-bar 30 without departing from the principles of the present invention. Thus, in order to render the side piece pivotable relative to the back piece 12, it is only necessary for one of the side piece 14 and back piece 12 to define a vertically spaced plurality of lugs 50 and the other of the side piece 14 and the back piece 12 to define a vertically spaced plurality of slits 54, with the ends of the pivot member 60 being journalled into the other of the side piece 14 and the back piece 12.

The only screws or nails 42 required for construction of the bookcase 10 are those which secure the connecting means 32 to the T-bars 30 and these are driven in from the back of the bookcase 10 so as not to be visible from the front or sides thereof.

The shelves 16 are dimensioned and vertically spaced so that, when each shelf is in the upright storage or collapsed vertical orientation, the top of the topmost shelf 16, the top of the back piece 12 (at least the top of the T-bars 30 thereof) and the top of the side pieces 14 are all at a common level, as shown in FIG. 1. Thus, when the bookcase is in the collapsed or storage orientation, any impact to the top thereof is distributed over the various components, thus minimizing the resultant damage from the impact.

While the present invention has been described in terms of a back piece 12 wherein the connecting means 32 are rigidly and non-pivotably secured to the back internal corner, for special applications it may be desirable that the connecting means 32, like the side pieces 14, be pivotally secured to the T-bar 30 such that a side piece 14 is pivotally secured in one internal corner and a connecting means 32 is pivotally secured in the adjacent internal corner. To that end, the adjacent edge of the connecting means is preferably rounded and provided with a slit to receive the lug 50 of the internal corner. Additionally, a pivot member 60 extends through the slit (and hence through the lug aperture), the ends of the pivot member being journalled in the connecting means.

The T-bar 30 of the present invention finds utility in many applications. For example, still in the context of a bookcase, where it is desired that the side pieces 14 not extend more than the width of the bookcase in the collapsed orientation, two half-size side pieces may be employed with a T-bar 30 therebetween to replace each full size side piece 14. The adjacent edges of the two half-size side pieces enter the two internal corners of the T-bar 30 and are pivotally secured to the T-bar therebetween such that the two half-size side pieces are movable between orientations parallel to one another and in a straight line.

To summarize, the present invention provides folding furniture which does not utilize visible external hinges, but only hidden internal hinges and may be in the form of a bookcase wherein the side pieces are pivotable over a 90° angle relative to the back piece without reducing the shelf space available for the books. The folding furniture appears to have been purchased in the erected state, yet is simple and inexpensive to manufacture and erect and durable in both the folded and the erected orientations.

Now that the preferred embodiments of the present invention have been shown and described in detail, various modifications and improvements thereon will become readily apparent to those skilled in the art. Accordingly, the spirit and scope of the present invention is to be construed broadly and limited only the appended claims, and not by the foregoing specification.

I claim:

1. In a folding article of furniture comprising:

(A) a vertically extending back piece;

(B) at least one vertically extending side piece secured to said back piece and pivotable over a 90° angle relative to said back piece between a parallel or collapsed orientation and a perpendicular or use orientation; and (C) a vertically spaced plurality of shelves, each shelf being secured to said back piece and pivotable over a 90° angle relative to said back piece between a parallel or collapsed vertical orientation and a perpendicular or use horizontal orientation;

the improvement wherein said side piece and said back piece are secured together by at least one hidden internal hinge.

2. The article of claim 1 wherein one of said side piece and said back piece defines a vertically spaced plurality of lugs, each said lug defining an aperture therethrough;

the other of said side piece and said back piece defines a vertically spaced plurality of slits, each said slit being disposed, configured and dimensioned to receive a respective one of said lugs with said lug aperture in said slit; and said article additionally defines at least one pivot member, each said pivot member having a body extending vertically through the aperture of a respective one of said lugs and a pair of opposed ends journalled into said other of said side piece and said back piece above and below said respective one lug aperture.

3. The article of claim 2 wherein said article defines a vertically spaced plurality of said pivot members, each pivot member extending vertically through a respective one of said lug apertures and being journalled into said other of said side piece and said back piece above and below said respective one lug aperture.

4. The article of claim 2 wherein said back piece comprises a horizontally spaced pair of vertically extending T-shaped side bars and means connecting said side bars, each said side bar defining in cross section a transverse member and an inwardly extending flange forming a pair of internal corners, one of said internal corners being occupied in part by said connecting means and the other of said internal corners being occupied in part by an edge of said side piece without blocking pivotal movement of said side piece edge over a 90° angle.

5. The article of claim 1 wherein said back piece comprises a horizontally connected pair of vertically extending T-shaped side bars.

6. The article of claim 1 wherein a front of an uppermost of said shelves is pivotable upwardly such that, when said article is in a collapsed orientation with said uppermost shelf intermediate said back piece and said side piece, said uppermost shelf, said back piece and said side piece define tops at a common level.

7. The article of claim 1 wherein said back piece has a horizontally spaced pair of lateral ends, and said article has a pair of said side pieces, each said side piece being secured to a respective lateral end of said back piece.

8. The article of claim 1 in the form of a bookcase.

9. In a folding bookcase comprising:

(A) a vertically extending back piece having a horizontally spaced pair of lateral ends;

(B) a pair of vertically extending side pieces, each side piece being secured to a respective lateral end of said back piece and pivotable over a 90° angle relative to said back piece between a parallel or collapsed orientation and a perpendicular or use orientation; and (C) a vertically spaced plurality of shelves, each shelf being secured to said back piece and pivotable over a 90° angle relative to said back piece between a parallel or collapsed vertical orientation and a perpendicular or use horizontal orientation;

the improvement wherein (a) said back piece and each said side pieces are secured together by at least one hidden internal hinge;

one of said back piece and a respective side piece defines a vertically spaced plurality of lugs, each lug defining an aperture therethrough;

the other of said back piece and said respective side piece defines a vertically spaced plurality of slits, each said slit being disposed, configured and dimensioned to receive a respective one of said lugs with said lug aperture in said slit; and said article additionally defines a vertically spaced plurality of pivot members, each pivot member having a body extending vertically through the aperture of a respective one of said lugs and a pair of opposed ends journalled into said other of said back piece and said respective side piece above and below said respective one lug aperture; and (b) said back piece includes a horizontally spaced pair of vertically extending T-shaped side bars and means connecting said side bars, each said side bar defining in cross section a transverse member and an inwardly extending flange forming a pair of internal corners, one of said internal corners being occupied in part by said connecting means and the other of said internal corners being occupied in part by an edge of one of said side pieces without blocking pivotal movement of said one side piece edge over a 90° angle; and (c) a front of an uppermost of said shelves is pivotable upwardly such that, when said article is in a collapsed orientation with said uppermost shelf intermediate said back piece and said side pieces, said uppermost shelf, said back piece and said side pieces define tops at a common level.

10. In a folding article of furniture comprising:

(A) a vertically extending back piece; and (B) a horizontally aligned, vertically extending side piece secured to said back piece and pivotable horizontally over a 90° angle relative to said back piece between a parallel or collapsed orientation and a perpendicular or use orientation;

the improvement wherein said side piece and said back piece are secured together by at least one hidden internal hinge.

11. The article of claim 10 wherein one of said side piece and said back piece defines a vertically spaced plurality of lugs, each said lug defining an aperture therethrough;

the other of said side piece and said back piece defines a vertically spaced plurality of slits, each said slit being disposed, configured and dimensioned to receive a respective one of said lugs with said lug aperture in said slit; and said article additionally defines at least one pivot member, each said pivot member having a body extending vertically through the aperture of a respective one of said lugs and a pair of opposed ends journalled into said other of said side piece and said back piece above and below said respective one lug aperture.

12. The article of claim 10 additionally including a vertically spaced plurality of shelves, each shelf being secured to said back piece and pivotable over a 90° angle relative to said back piece between a parallel or collapsed vertical orientation and a perpendicular or use horizontal orientation.

13. The article of claim 1 wherein each of said side piece and said back piece is unbent wood.

14. The bookcase of claim 9 wherein each of said side pieces and said back piece is unbent wood.

15. The article of claim 10 wherein each of said side piece and said back piece is unbent wood.

* * * * *